US005240375A

United States Patent [19]

Wayte

[11] Patent Number: 5,240,375

[45] Date of Patent: Aug. 31, 1993

[54] WEAR PROTECTION SYSTEM FOR TURBINE ENGINE ROTOR AND BLADE

[75] Inventor: Peter Wayte, Cincinnati, Ohio

[73] Assignee: General Electric Company, Cincinnati, Ohio

[21] Appl. No.: 819,245

[22] Filed: Jan. 10, 1992

[51] Int. Cl.[5] ..... F01D 5/30

[52] U.S. Cl. ..... 416/219 R; 416/220 R; 416/248

[58] Field of Search ..... 416/219 R, 220 R, 221, 416/224, 241 R, 248, 500

[56] References Cited

U.S. PATENT DOCUMENTS

| | | | |
|---|---|---|---|
| 2,874,932 | 2/1959 | Sorensen | 416/220 |
| 5,160,243 | 11/1992 | Herzner et al. | 416/220 R |

FOREIGN PATENT DOCUMENTS

| | | | |
|---|---|---|---|
| 113804 | 5/1987 | Japan | 416/241 R |
| 2196105 | 8/1990 | Japan | 416/219 R |
| 709636 | 6/1954 | United Kingdom | 416/241 R |
| 836030 | 6/1960 | United Kingdom | 416/241 B |
| 1355554 | 6/1974 | United Kingdom | 416/221 |

*Primary Examiner*—Edward K. Look
*Assistant Examiner*—James A. Larson
*Attorney, Agent, or Firm*—Jerome C. Squillaro; Carmen Santa Maria

[57] ABSTRACT

An improved type wear protection system for a turbine engine rotor and blade, in which a multilayer clad shim is interposed between a dovetail portion of a blade and the dovetail slot portion of a rotor, is described. The shim, preferably comprised of surface layers of phosphor bronze and a center layer of austenitic stainless steel, is especially effective in preventing fretting damage to titanium engine components.

10 Claims, 3 Drawing Sheets

WEAR PROTECTION SYSTEM FOR TURBINE ENGINE ROTOR AND BLADE

This application is related to co-pending applications Ser. No. 641,229 (Wayte) and Ser. No. 641,230, U.S. Pat. No. 5,160,243, (Herzner et al.), both filed Jan. 15, 1991, and both assigned to the assignee hereof. The entirety of the disclosure of each of these related applications is incorporated herein by reference.

BACKGROUND OF THE INVENTION

This invention relates to turbine engines, and, more particularly, to the reduction of frictionally induced wear damage within the rotors of the compressor and fan stages of these engines.

When two pieces of material rub or slide against each other in a repetitive manner, the resulting frictional forces can cause damage to the materials through the generation of heat or through a variety of fatigue processes generally termed fretting. Some materials systems, such as titanium contacting titanium, are particularly susceptible to such damage.

When two pieces of the same or substantially the same metal, for example titanium, are rubbed against each other with an applied normal force, the pieces can exhibit another type of surface damage called galling. Titanium may gall after as little as a hundred cycles.

Both fretting and galling increase with the number of cycles and can eventually lead to failure of either or both pieces by fatigue.

The use of titanium parts that can potentially rub against each other occurs in several aerospace applications. Titanium alloys are used in aircraft and aircraft engines because of their good strength, low density and favorable environmental properties at low and moderate temperatures. If a particular design requires titanium pieces to rub against each other, the types of damage just outlined may occur.

In one type of aircraft engine design, a titanium compressor disk, also referred to as a rotor, or fan disk or rotor has an array of dovetail slots in its outer periphery. The dovetailed base of a titanium compressor or fan blade fits into each dovetail slot of the disk. When the disk is at rest, the dovetail of the blade is retained within the slot. When the engine is operating, centrifugal force induces the blade to move radially outward. The sides of the blade dovetail slide against the sloping sides of the dovetail slot of the disk, producing relative motion between the blade and the rotor disk.

This sliding movement occurs between the rotor and blade titanium pieces during transient operating conditions such as engine startup, power-up (takeoff), powerdown, and shutdown. With repeated cycles of operation, the sliding movement can affect surface topography and lead to a reduction in fatigue capability of the mating titanium pieces. During such operating conditions, normal and sliding forces exerted on the rotor in the vicinity of the dovetail slot can lead to galling, followed by the initiation and propagation of fatigue cracks in the disk. It is difficult to predict when initiation of cracks may occur or extent of damage in relation to the actual number of engine cycles. Engine operators, such as the airlines, must therefore inspect the interior surfaces of the rotor dovetail slots frequently, which is a highly laborious process.

Various techniques have been tried to avoid or reduce the damage produced by the frictional movement between the titanium blade dovetail and the dovetail slot of the titanium rotor disk. At the present time, the most widely accepted technique is to coat the contacting regions of the titanium pieces with a metallic alloy to protect the titanium parts from fretting or galling. The sliding contact between the two coated contacting regions is lubricated with a solid dry film lubricant containing primarily molybdenum disulfide, to further reduce friction.

While this approach can be effective in reducing the incidence of fretting or fatigue damage in rotor/blade pieces, the service life of the coating has been shown to vary considerably. Furthermore, the application process for applying the metallic alloy to the disk and the blade pieces has been shown to be capable of reducing the fatigue capability of the coated pieces. There exists a continuing for an improved approach to reducing such damage and ensure component integrity. Such an approach would desirably avoid a major redesign of the rotor and blades, which have been optimized over a period of years, while increasing the life of the titanium components and the time between required inspections. The present invention fulfills this need, and further provides related advantages.

A new approach to reduce the incidence of fretting in high temperature components described in European Patent Application 89106921.3 utilizes two independent, but superposed foils having material contact surfaces with a low coefficient of friction, but surfaces which mate with the dovetail and dovetail slot having high coefficients of friction. The foils allow sliding movement along the material contact surfaces, having the low coefficient of friction, but prevent sliding between the foil and the mating parts due to the high coefficient of friction. Experience with this type of design has shown that each of the thin foils gradually works its way out of the dovetail slot region, leaving the blade dovetail and rotor dovetail slot in contact, resulting in fretting. In one embodiment, the foils have formed flanges. The flanges are necessarily small because of the small gap between blade dovetail and the rotor dovetail slot, and although providing some improvement, are not expected to eliminate the problem of gradual movement of the foil.

In another new approach described by Herzner et al. (application Ser. No. 641,230, filed Jan. 15, 1991) a reinforced shim is attached to the dovetail of a fan or compressor blade, and the blade with attached shim is placed in the rotor dovetail slot. The shim is reinforced with a metallic doubler, configured in such a way as to prevent the shim from working its way out of the dovetail slot region. The shim is made from a material other than the titanium alloys frequently selected for compressor and fan rotors and blades, and phosphor bronze is identified as the preferred material for the portion of the shim which is interposed between the contacting surfaces of the blade and rotor.

SUMMARY OF THE INVENTION

The present invention provides an improved approach to reducing fatigue-induced damage from fretting to titanium blades and titanium rotors of the compressor or fan of a gas turbine engine, induced by sliding contact of the blade dovetail and the rotor dovetail slot. The approach comprises placement of a multilayer clad shim between the blade and rotor. The wear life of the titanium parts is thereby increased, as compared with prior approaches, and the life is also more consistent.

Neither the rotor dovetail slots nor the blade dovetails require special coatings to reduce wear, and therefore there is no need for special coating processes which might adversely affect base material properties. When the wear life of the shim of the present invention is reached, the engine may be readily refurbished for further service by replacing the shim.

In accordance with the invention, a rotor and blade assembly comprises a titanium rotor having a plurality of dovetail slots in the circumference thereof, each dovetail slot including side walls and a bottom; a titanium blade corresponding to each slot having a dovetail sized to fit into the dovetail slot and contact the rotor along a pair of contacting regions on the side walls of the dovetail slot, one contacting region of each side of the dovetail slot, there remaining a non-contacting region between each dovetail slot bottom and the blade dovetail bottom; and a multilayer clad shim disposed in this non-contacting region between each blade dovetail bottom and the rotor dovetail slot bottom, the shim including means for inhibiting fretting wear of the titanium blade dovetail and the titanium rotor in the contacting region of the dovetail slot. As used herein, the term "titanium" includes both pure titanium and titanium alloys.

Further in accordance with the invention, the multilayer clad shim is comprised of a least three layers, including two surface layers and a central layer, wherein the central layer is disposed between the surface layers and permanently joined to each surface layer. The phrase "multilayer clad shim" is used to emphasize the permanent nature of the joints between the surface layers and the central layer. Each surface layer comprises means for inhibiting fretting wear at regions of contact between the shim and the titanium rotor, and between the shim and the titanium blade; contact between the titanium parts is substantially eliminated. The preferred material for the surface layers is a phosphor bronze, of which several different alloys are commercially available. These alloys contain between 1 and 10 weight percent tin, up to about 0.2 percent phosphorus, balance copper; the alloy containing 5 percent tin and 0.1 percent phosphorus is especially useful in the present invention. A typical material for the center layer is austenitic stainless steel, such as Type 304, which has a nominal composition of 19 weight percent chromium, 9 percent nickel, balance iron. The strength of the center layer is great enough that the shim retains its manufactured shape during operation of the engine, thereby preventing gradual movement of the shim from the region between the blade dovetail and the rotor dovetail slot. Because the shim remains in position between the blade and the rotor during engine operation, while preventing contact between the blade and rotor, it continues to inhibit fretting wear on the blade and rotor.

The present invention permits the use of other fatigue reducing techniques. The occurrence of fatigue damage may be further reduced by surface hardening, lubrication, or any other technique known in the art, as applied to the blade dovetail, the rotor dovetail slot, or the shim. Other features and advantages of the invention will be apparent from the following more detailed description of the preferred embodiments, taken in conjunction with the accompanying drawings, which illustrate, by way of example, the principles of the invention.

DETAILED DESCRIPTION OF THE INVENTION

Figure 1:
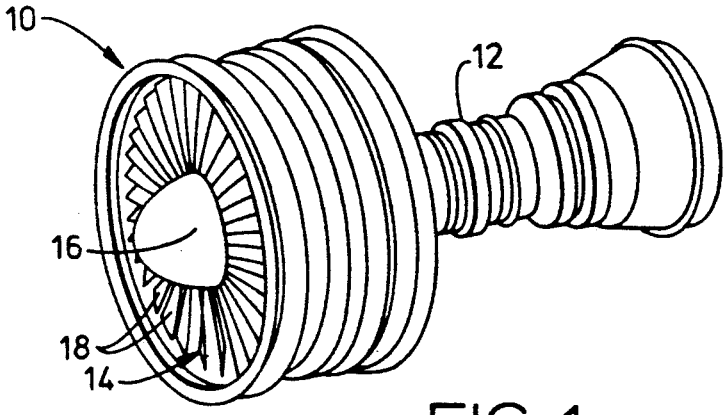
FIG. 1 is a perspective view of a gas turbine engine.

The shim of the present invention is preferably used in conjunction with an aircraft gas turbine engine 10 such as that shown in FIG. 1. The engine 10 includes a turbine section 12 with a bypass fan 14 driven thereby. The bypass fan 14 includes a fan disk or rotor 16 having a plurality of fan blades 18 mounted thereto. The use of the present invention will be discussed in relation to the fan rotor and blades, but it is equally applicable to the compressor rotor and blades in the compressor portion of the gas turbine engine 10, particularly in the forward portion of the compressor where the operating temperatures are below about 800° F. In the embodiments discussed herein, the fan blades, fan rotors, compressor blades and compressor rotors are made of titanium. However, the rotor or disk and the mating blades may be made of any alloy or combination of alloys which tend to fret or gall when brought into mating contact with one another, and in particular, when the mating surfaces move relative to one another.

Figure 2:
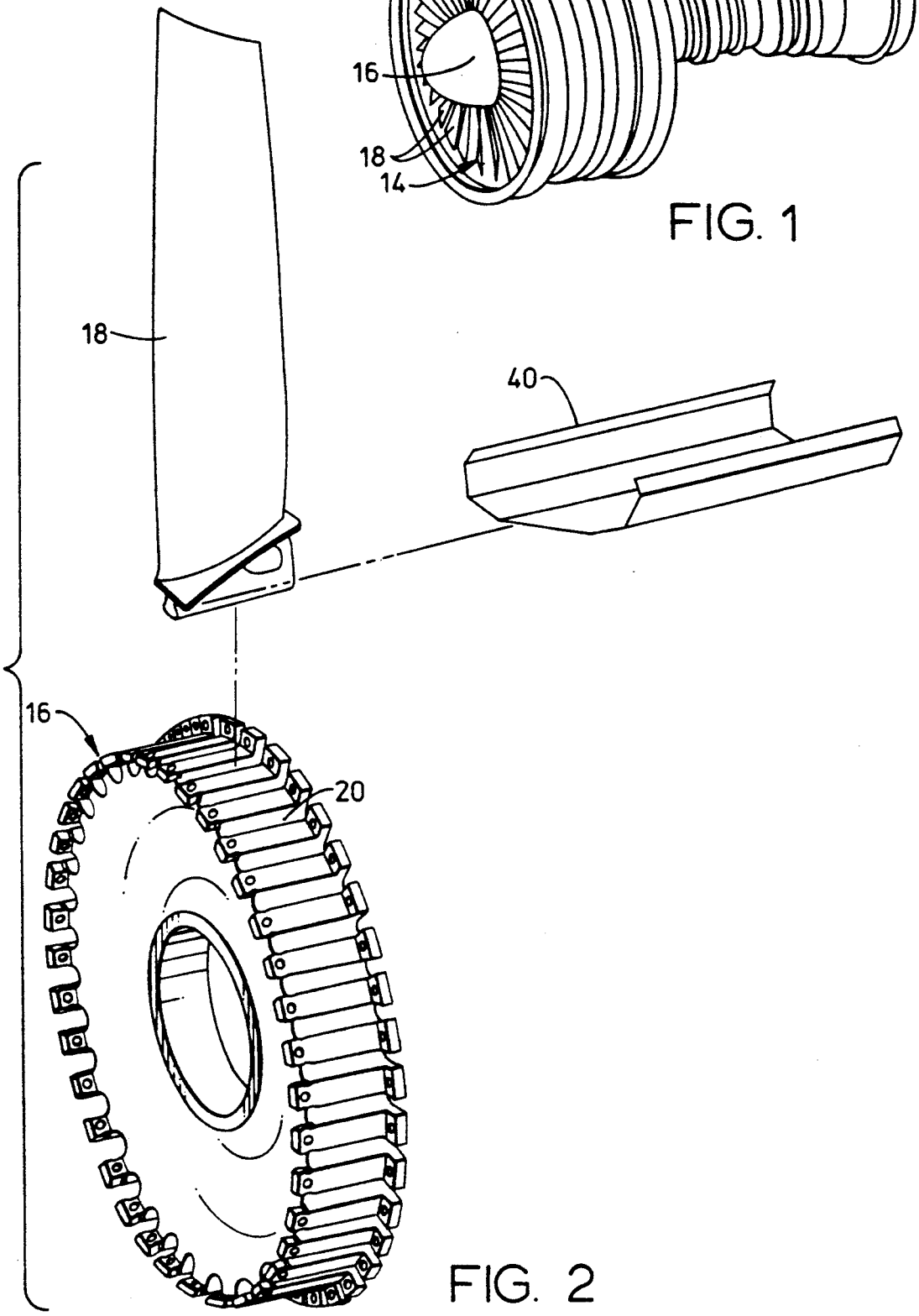
FIG. 2 is a perspective exploded view of a fan rotor, fan blade, and inserted shim.
Figure 4:
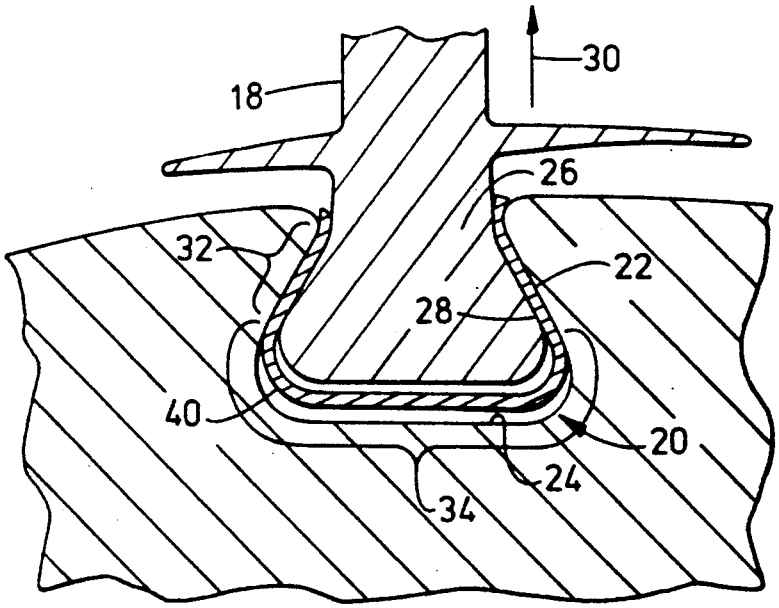
FIG. 4 is a side elevational view of a portion of an assembled fan rotor and fan blade with a multilayer clad shim positioned therebetween.
Figure 3:
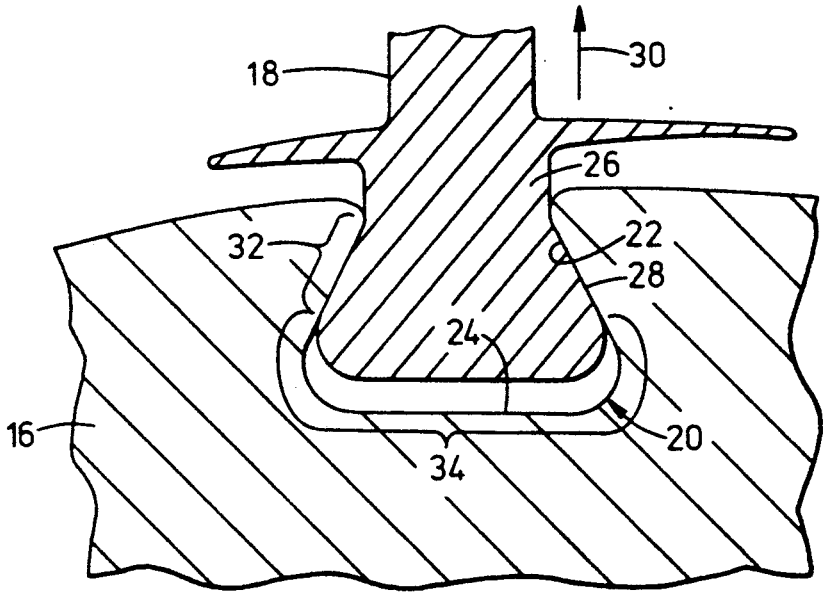
FIG. 3 (PRIOR ART)
FIG. 3 is a side elevational view of a portion of an assembled fan rotor and fan blade, illustrating a configuration representative of the prior art.

The assembly of the fan blades to the fan rotor is illustrated in greater detail in FIGS. 2 through 4. FIGS. 3 and 4 are similar, except that FIG. 3 represents the prior art and FIG. 4 illustrates features of the present invention. The rotor 16 has a plurality of dovetail slots 20 around its circumference, opening circumferentially outward. Each dovetail slot 20 has sloping side walls 22 diverging in a direction from the circumference toward the inward portion of the disk or rotor, but terminating at a bottom 24. Each fan blade 18 has at its lower end a dovetail 26 with side faces 28 sloping outward in a direction from the blade body to the dovetail stub end. The blade dovetail 26 is configured and sized to slide into the rotor dovetail slot 20, as shown in FIG. 3.

When the rotor 16 is at rest, each blade dovetail 26 is retained within the rotor dovetail slot 20. The bottom of the blade dovetail may contact the bottom 24 of the rotor dovetail slot. When the engine 10 is operated, rotation of the rotor 16 about a central shaft results in movement of blade 18 outwardly due to centrifugal force, in the direction of the arrow 30 of FIGS. 3 and 4. The dovetail side face 28 then bears against the rotor dovetail slot side wall 22 to secure the blade 18 within the rotor dovetail slot 20 and prevent the blade 18 from being thrown from the rotor 16. The sliding motion of the blade dovetail combined with the dovetail contact pressure and the frictional forces between these parts produce shearing forces on the mating surfaces of both the blade and rotor. As will be apparent from an inspection of FIG. 3, there is a loaded contact region, generally indicated by numeral 32, on the slot side wall 22, and a non-contact region on the slot side wall 22 and the slot bottom 24, generally indicated by numeral 34, where there is no such loaded contact.

As the engine 10 is operated from rest, through flight operations, and then again to rest, constituting what is generally referred to as a "cycle", the blade 18 is pulled in the direction 30 with varying loads. The blade dovetail side 28 and the rotor dovetail slot side wall 22 slide past each other by a distance that is small, typically about 0.010 inch or less, but sufficient to cause fretting damage. Of most concern is that damage to the rotor 16, as small cracks, may occur after repeated cycles. Such cracks can extend into the rotor 16 from the dovetail slot side wall 22, and may eventually lead to failure of the rotor.

Figure 5:
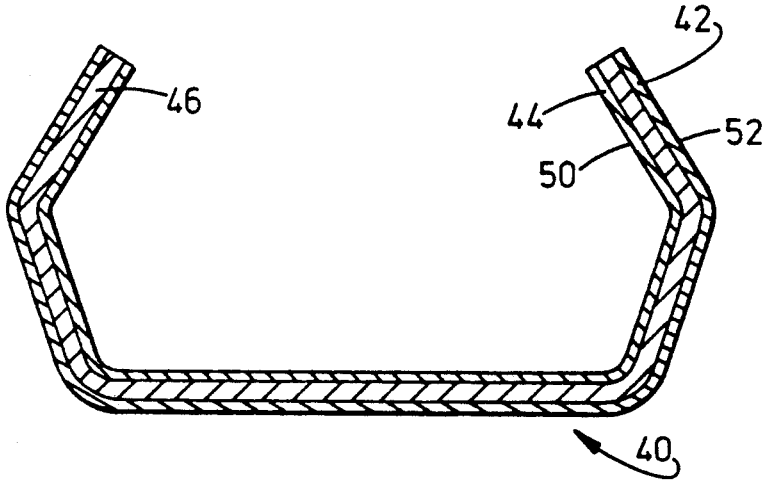
FIG. 5 is a cross sectional view of a multilayer clad shim.

According to the invention, the wear and fatigue damage that would otherwise occur at the contact regions because of the sliding motion at the blade dovetail side faces 28 and the slot side walls 22 of the rotor 16 is reduced by inserting a multilayer clad shim 40 between the blade dovetail side faces 28 and the dovetail slot side walls 22. The placement of the shim 40 is illustrated in FIGS. 2 and 4, and the detailed construction of the shim is illustrated in FIG. 5. The thickness of the shim is from about 0.015 inch to about 0.040 inch, and preferably from about 0.020 inch to about 0.035 inch.

The shim 40 is a multilayer clad sheet formed so that it attaches to the blade dovetail 26 and is retained during operation between the blade dovetail 26 and the rotor slot side wall 22. The form of the shim 40 is generally a constricted U-shape, with the upper portion of each leg of the U bent slightly toward the other leg. Preferably, the form of the shim conforms to that of the blade dovetail 26. The shim 40 is sufficiently long that it extends around the blade dovetail stub end and covers the dovetail side faces 28. In operation, the inner surface of the shim 50 contacts the dovetail side faces 28 and the outer surface of the shim 52 contacts the dovetail slot side walls 22, completely separating the blade dovetail side faces 28 and the rotor dovetail slot side walls 22 so that they cannot contact each other along the contacting surface 32. The dimensions of the dovetail slot 20 and/or the dovetail 26 must necessarily be adjusted to accommodate the multilayer clad shim 40 which is disposed therebetween.

The blades are assembled to the rotor by sliding a shim onto each blade and inserting the blade/shim assembly into the rotor dovetail slot in the conventional manner. If desired, a lubricant may be applied onto the shim, the rotor dovetail slot of the blade dovetail prior to, or during, assembly.

The shim 40 is made from multilayer sheet material, as illustrated in FIG. 5. The outer surface layer 42 and the inner surface layer 44 are comprised of a material which inhibits fretting when placed in contact with the rotor and blade materials, respectively, under the type of motion and loading described above. Layers 42 and 44 may be the same material, or different materials. Phosphor bronze having a nominal composition, in weight percent, of about 4 to 6 percent tin and about 0.05 to 0.15 percent phosphorus, balance copper, is a preferred material. The surface layers must have a strength level sufficient to withstand the stresses between the blade and rotor during engine operation. In a fan rotor application, this strength level corresponds to a tensile strength between about 60,000 psi and about 90,000 psi, with tensile elongation of at least 12 percent. The center layer 46 is comprised of a material which is compatible with the surface layers, yet which can be processed to a tensile strength of between about 110,000 psi and about 190,000 psi and a tensile elongation of at least 10 percent, and retain that strength after extended exposure to temperatures approaching 800° F. Austenitic stainless steel such as AISI Type 304 is preferred for the center layer. There is some latitude in the mechanical property levels for both surface and center layers; however, the strength levels must be high enough to support the loads characteristic of engine operation, yet the ductility must be high enough to permit forming the material into the required shape.

The dimensions of the shim must necessarily be selected to fit the dimensions of a particular rotor and blade application. The central layer must be thick enough to support the surface layers, while providing sufficient rigidity to prevent the shim from working its way out of its proper location between the rotor and the blade. The preferred thickness for the central layer is from about 0.010 to about 0.015 inch, although thickness will vary with fan size, a larger fan requiring a thicker layer.

The surface layers must be thick enough so that the fret-resistant material is not worn away between scheduled maintenance inspections. The preferred thickness is between about 0.002 and about 0.005 inch.

While phosphor bronze of the above composition is the preferred material for the surface layers, other materials may be used. For example, commercially available copper base alloys of the following nominal compositions may be used: Cu-9Ni-2.5Sn and Cu-10Al-1Fe. Other austenitic stainless steels, or nickel base alloys, may be used for the center layer.

The surface layers 42, 44 and the center layer 46 may be joined together by any convenient method. For example, the surface layers may be joined to the center layer by cold rolling in a manner similar to that used to make U.S. coinage. The joint produced by this process is normally a permanent joint, which is usually considered to be a metallurgical bond. For the present invention, the schedule of cold rolling reduction steps and intervening annealing processes would be selected such that the preferred mechanical properties are obtained.

The performance of the multilayer clad shim is enhanced by lubricating at least the portion of the shim which is interposed between the blade dovetail 26 and the rotor dovetail slot side wall 22. A variety of lubricants will suffice; the dry film lubricant described in copending application Ser. No. 641,229, filed Jan. 15, 1991 is preferred.

EXAMPLE 1

The ability of materials to resist fretting can be measured in a sliding wear test. In one form of this test, a block of a first test material is affixed to a stationary frame of the test apparatus, and a coupon of a second test material is affixed to a movable shoe of the test apparatus. The movable shoe is reciprocated in a direction parallel to the surface of the test block under a perpendicular contact stress of 80,000 pounds per square inch. The magnitude of the reciprocating motion is about 0.008 inch, at a frequency of 1 Hz. For each test described in these Examples, the material of the test block was Ti-6Al-4V, a widely used titanium alloy. The coefficient of friction between the two materials under test is monitored to provide an indication of onset of surface damage by fretting and/or galling.

In one test, the second test material was also Ti-6Al-4V. Galling occurred so rapidly and so severely that the test wa discontinued after only 200 cycles.

EXAMPLE 2

In another test of the type described in Example 1, the second test material was a strip of phosphor bronze having a nominal composition of about 5% Sn, 0.1% P, bal Cu was affixed to the movable shoe. The thickness of the strip was about 0.018 inch. After 1,600 cycles, the thickness was reduced by 0.009 inch. The coefficient of friction increased from 0.45 at the beginning of the test to 0.71 at termination. The use of phosphor bronze as one test material increased life in this sliding wear test by a factor of 8 over the test in Example 1.

EXAMPLE 3

In a third test of the type described in Example 1, the second test material was a multilayer clad strip of the type contemplated for manufacturing the shims of the present invention. The shim material was comprised of two phosphor bronze surface layers and AISI Type 304L stainless steel structural center layer, having the preferred strength levels described above. The nominal composition of the phosphor bronze was about 5% Sn, 0.1% P, bal Cu; the nominal composition of the stainless steel was 19% Cr, 9% Ni, bal Fe. Each surface layer was about 0.005 inch thick; the center layer was about 0.010 inch thick. After 10,000 cycles of testing, about 0.004 inch of material has been worn away from the surface layer in reciprocating contact with the titanium alloy block. The coefficient of friction increased from 0.32 at the beginning of the test to 0.65 at termination. The use of the multilayer clad material increased life in this sliding wear test by a factor of 6 over the test in Example 2, and by a factor of 50 over the test in Example 1.

In light of the foregoing discussion, it will be apparent to those skilled in the art that the present invention is not limited to the embodiments, methods and compositions herein described. Numerous modifications, changes, substitutions and equivalents will become apparent to those skilled in the art, all of which fall within the scope contemplated by the invention.

I claim:

1. A rotor and blade assembly for a gas turbine engine, comprising:

a rotor having a dovetail slot in a rotor circumference thereof, the dovetail slot including at least a pair of side walls diverging in a direction from the circumference toward an inward portion of the rotor, and terminating at a bottom;

a blade having a dovetail at a first end thereof, the dovetail including at least a pair of side faces diverging in a direction along the blade toward its first end and terminating in a stub end; and a multilayer clad shim comprising a structural center strip having sufficient strength and rigidity to maintain its manufactured shape and having two faces, a first surface layer permanently joined to a first face of the strip by cold rolling and a second surface layer permanently joined to a second face of the strip by cold rolling;

wherein each surface layer is comprised of an antifretting material having sufficient strength to withstand stresses between the blade and rotor during engine operation and sufficient ductility for forming into the manufactured shape; and wherein the shim is disposed between the dovetail and the dovetail slot, such that a portion of the first surface layer of the shims contacts at least a portion of each side face of the dovetail, and such that a portion of the second surface layer of the shim contacts at least a portion of each side wall of the dovetail slot.

2. The assembly of claim 1, wherein the rotor and the blade are each comprised of titanium.

3. The assembly of claim 1, wherein the antifretting material is a phosphor bronze.

4. The assembly of claim 1, wherein the structural center strip is comprised of an austenitic stainless steel.

5. The assembly of claim 1, wherein the shim additionally comprises a lubricant applied to at least one surface layer.

6. The assembly of claim 1, wherein the rotor has a plurality of dovetail slots spaced around its rotor circumference, and a blade and a shim are provided in each dovetail slot.

7. A multilayer clad shim for assembly into a gas turbine engine having a dovetail slot between a rotor and a blade having a dovetail, comprising a structural center strip having sufficient strength and rigidity to maintain its manufactured shape and having two faces, a first surface layer permanently joined to a first face of the strip by cold rolling and a second surface layer permanently joined to a second face of the strip by cold rolling, wherein each surface layer is comprised of an antifretting material having sufficient strength to withstand stresses between the blade and rotor during engine operation and sufficient ductility for forming into the manufactured shape, and wherein the shim is configured to fit into the dovetail slot between the rotor of the gas turbine engine and the dovetail of the blade in the engine, and further configured to prevent contact between the dovetail and the dovetail slot upon positioning the shim therebetween.

8. The shim of claim 7, wherein the surface layers are comprised of a phosphor bronze.

9. The shim of claim 7, wherein the structural center strip is comprised of an austenitic stainless steel.

10. The shim of claim 7, wherein the shim additionally comprises a coating of lubricant applied to at least one surface layer.

* * * * *